US010117298B1

(12) United States Patent
Loomis et al.

(10) Patent No.: US 10,117,298 B1
(45) Date of Patent: Oct. 30, 2018

(54) CURTAIN-CONFIGURED LIGHT STRINGS

(71) Applicant: Seasons 4, Inc., Toano, VA (US)

(72) Inventors: Jason Loomis, Decatur, GA (US); Jared William Everline, Atlanta, GA (US)

(73) Assignee: Seasons 4, Inc., Toano, VA (US)

( * ) Notice: Subject to any disclaimer, the term of this patent is extended or adjusted under 35 U.S.C. 154(b) by 0 days.

(21) Appl. No.: 15/967,184

(22) Filed: Apr. 30, 2018

Related U.S. Application Data

(63) Continuation-in-part of application No. 15/484,847, filed on Apr. 11, 2017, now Pat. No. 9,986,610.

(51) Int. Cl.

| | |
|---|---|
| ***H05B 33/08*** | (2006.01) |
| ***F21S 4/10*** | (2016.01) |
| ***F21V 23/00*** | (2015.01) |
| ***F21V 23/06*** | (2006.01) |
| ***F21V 23/02*** | (2006.01) |
| *F21W 121/00* | (2006.01) |
| *F21Y 115/10* | (2016.01) |
| *F21Y 103/10* | (2016.01) |
| *F21Y 113/13* | (2016.01) |

(52) U.S. Cl.
CPC ..... *H05B 33/0857* (2013.01); *F21S 4/10* (2016.01); *F21V 23/001* (2013.01); *F21V 23/02* (2013.01); *F21V 23/06* (2013.01); *H05B 33/0824* (2013.01); *F21W 2121/00* (2013.01); *F21Y 2103/10* (2016.08); *F21Y 2113/13* (2016.08); *F21Y 2115/10* (2016.08)

(58) Field of Classification Search
CPC ..... H05B 33/08; H05B 33/0845; H05B 33/0857; H05B 33/0824; F21V 23/02; F21V 23/001; F21V 23/06; F21Y 2103/10; F21Y 2113/13; F21Y 2115/10; F21W 2121/00
USPC .... 315/129–134, 185 R, 150–152, 291, 307, 315/308, 312
See application file for complete search history.

(56) References Cited

U.S. PATENT DOCUMENTS

| | | | |
|---|---|---|---|
| 8,217,587 | B2 | 7/2012 | Sauerlaender |
| 8,450,950 | B2 | 5/2013 | McRae |
| 8,807,796 | B2 | 8/2014 | Li |
| 8,941,312 | B2 | 1/2015 | McRae |
| 8,988,013 | B2 | 3/2015 | McRae |

(Continued)

*Primary Examiner* — Jimmy Vu
(74) *Attorney, Agent, or Firm* — Kinney & Lange, P.A.

(57) ABSTRACT

Apparatus and associated methods relate to a curtain configured decorative lighting system. The curtain configuration of decorative light stings is obtained by using light-string distribution elements, each of which receives an input signal by a conductive lead. The input signal is indicative of a plurality of lighting commands. The light-string distribution element then provides an output signal to a tap connector, to which a decorative light string can be connected. The provided output signal is indicative of lighting commands corresponding to a plurality of lighting elements distributed along the decorative light string connected thereto. The plurality of lighting elements of the attached decorative light string each illuminate in response to one of the lighting commands indicated by the output signal. In some embodiments, the decorative light string provides to the tap connector a signal indicative of lighting commands that do not correspond to lighting elements of that decorative light string.

20 Claims, 9 Drawing Sheets

(56) References Cited

U.S. PATENT DOCUMENTS

| | | | | |
|---|---|---|---|---|
| 9,007,000 | B2 | 4/2015 | Szczeszynski et al. | |
| 9,089,030 | B2 | 7/2015 | Neuman | |
| 9,258,861 | B2 | 2/2016 | Chu et al. | |
| 9,313,846 | B2 | 4/2016 | Chen et al. | |
| 9,374,857 | B2 | 6/2016 | McRae et al. | |
| 2011/0101889 | A1* | 5/2011 | Lys ..... | H05B 33/0803 315/312 |
| 2014/0035481 | A1 | 2/2014 | Peting et al. | |
| 2015/0084515 | A1 | 3/2015 | Altamura et al. | |
| 2015/0359066 | A1 | 12/2015 | Loomis | |

* cited by examiner

CURTAIN-CONFIGURED LIGHT STRINGS

CROSS-REFERENCE TO RELATED APPLICATION(S)

This application is a continuation in part of U.S. patent application Ser. No. 15/484,847, entitled "LONG-CHAIN-TOLERANT DECORATIVE STRINGS OF INDEPENDENTLY ILLUMINATION CONTROLLABLE LEDS" filed Apr. 11, 2017, by Jason Loomis and Jared William Everline, which is hereby incorporated by reference.

BACKGROUND

Decorative light strings are used to communicate a joy of a holiday season, to draw attention to merchandise, or to simply decorate or adorn an object. Decorative light strings can be used both indoors and outdoors. Decorative light strings have been used residentially to adorn trees, shrubs, and houses. Commercial businesses can use decorative light strings to provide festive atmospheres at their places of business.

Some such decorations can involve many decorative light strings. These light strings are often connected in series fashion. Series-connected decorative light strings receive their operating power from a connector at a first end and deliver power to strings connected to a second end of the decorative light string. Thus, a first decorative light string in a series-connected chain of decorative light strings carries the operating current for the entire series-connected chain of decorative light strings. Conversely, a last decorative light string in the series-connected chain will only carry the operating current for that last decorative light string.

Light strings traditionally have been constructed using incandescent bulbs. Light strings that use incandescent bulbs often have been powered using AC line voltages. In more recently times, Light Emitting Diodes (LED) have been used in light strings. LEDs usually require low-voltage DC power for illumination. Therefore, decorative light strings that use LEDs can be powered by low-voltage power levels. Providing a low-voltage power level to a series-connected chain of decorative light strings, however, can result in high current levels. Such high current levels can cause voltage droop along the series-connected chain, which in turn can cause the LEDs of the last decorative light string to be noticeably dimmer than the LEDs of the first decorative light string. Thus, a method of providing power to long chains of series-connected LED light strings that minimizes the dimming of the last decorative light string of the chain is desired.

SUMMARY

Apparatus and associated methods relate to a light-string distribution element for a decorative lighting system. The light-string distribution element includes a conductive lead configured to connect to an upstream element of the decorative lighting system. The conductive lead is further configured to receive, from the upstream element connected thereto, operating power. The conductive lead is also configured to receive, from the upstream element connected thereto, an input signal indicative of a plurality of lighting commands. Each of the plurality of lighting commands is configured to cause a particular lighting element to illuminate in a specific manner indicated by that lighting command. The light-string distribution element includes a tap connector configured to connect to a complementary connector of a decorative light string having a plurality of lighting elements. The tap connector is further configured to provide, to the decorative light string connected thereto, operating power received by the conductive lead. The tap connector is further configured to provide, to the decorative light string connected thereto, a first output signal indicative of a first subset of the plurality of lighting commands. The first subset of the plurality of lighting commands corresponds to lighting commands for a plurality of lighting elements of the decorative light sting connected thereto. The light-string distribution element also includes a conductive tail configured to connect to a downstream element. The conductive tail is further configured to provide, to the downstream element connected thereto, operating power received by the conductive lead. The conductive tail is also configured to provide, to the downstream element, a second output signal indicative of a second subset of the plurality of lighting commands. The second subset of lighting commands includes lighting commands for a plurality of lighting elements of other decorative light stings connected via the downstream element Some embodiments relate to a decorative light string that includes a plurality of lighting elements distributed along the decorative light string. Each of the plurality of lighting elements is configured to illuminate in a manner indicated by a light-control signal corresponding to that lighting element. The decorative light string includes a connector configured to receive, from a light-string distribution member connected thereto, operating power. The connector is further configured to receive, from the light-string distribution member connected thereto, an input signal indicative of a plurality of lighting commands. The plurality of lighting commands includes first and second subsets of the plurality of lighting commands. Each of the first subset of the plurality of lighting commands is configured to cause one of the plurality of lighting elements to illuminate in a specific manner indicated by that lighting command. The connector is further configured to provide, to the tap connector, an output signal indicative of the lighting commands of the second subset. The second subset of the plurality of lighting commands includes all lighting commands indicated by the input signal received by the connector except for the first subset of the plurality of lighting commands.

DETAILED DESCRIPTION

Apparatus and associated methods relate to a series-connectable decorative light string. High-voltage power is received via a first electrical connector at a first end of the decorative light string and is conducted to a complementary second electrical connector at a second end of the decorative light string. The decorative light string has a power converter that converts the received high-voltage power to low-voltage DC power for consumption by a plurality of lighting elements distributed along the decorative light string. Each of the plurality of lighting elements has an illumination controller. The plurality of lighting elements is wired in daisy chain fashion from the first electrical connector to the second electrical connector via data-in and data-out ports of each lighting element. The wire high-voltage power received by the first electrical connector can provide power to additional decorative light strings connected via the second electrical connector without resulting in degraded illumination.

Figure 1:
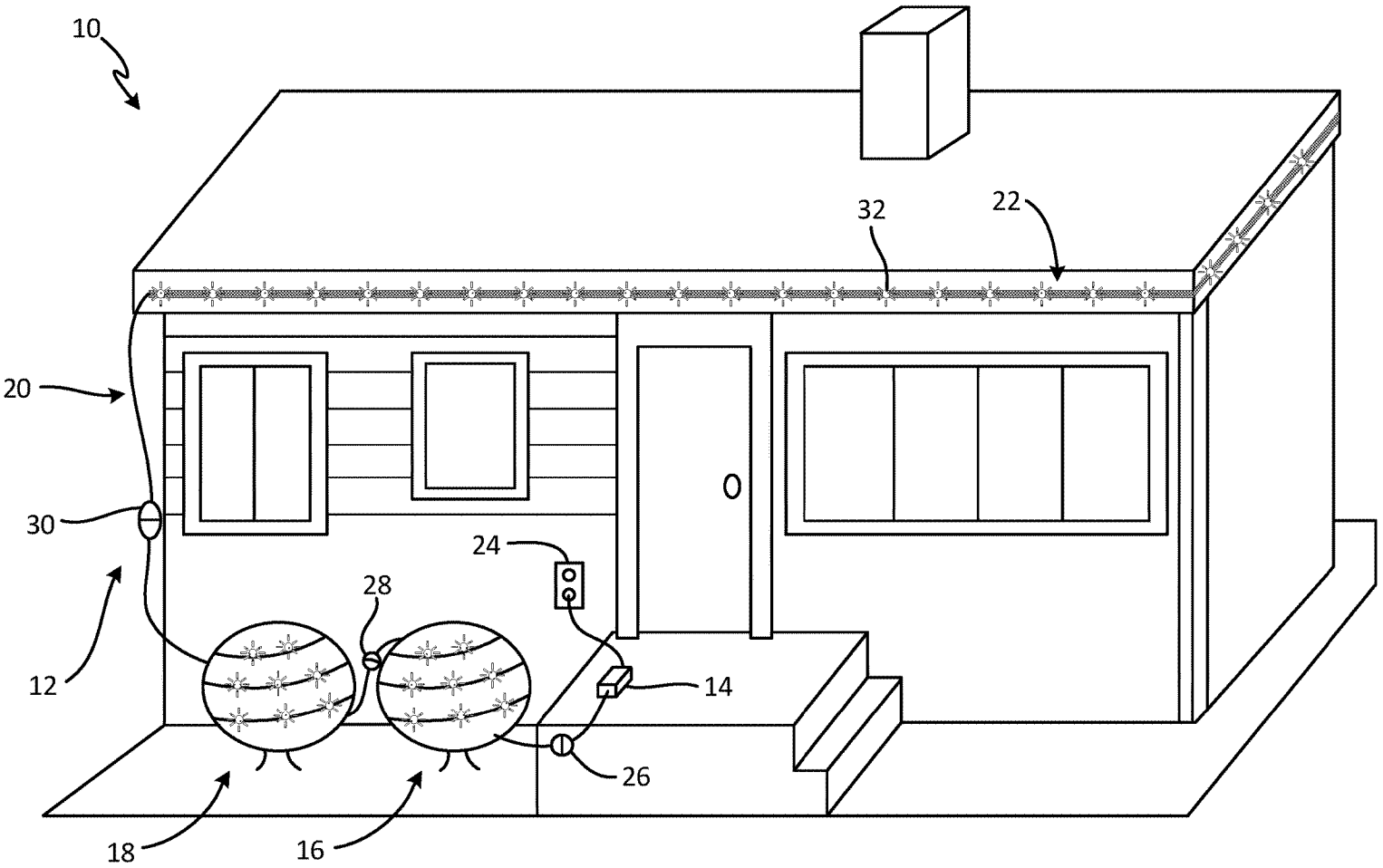
FIG. 1 is a schematic view of a home decorated with long chain of series-connected decorative light strings.

FIG. 1 is a schematic view of a home decorated with long chain of series-connected decorative light strings. In FIG. 1, home 10 is decorated with lighting system 12 for a holiday season. Lighting system 12 includes a power supply 14 and decorative LED light strings 16, 18, 20 and 22. Power supply 14 is plugged into house outlet 24 and draws operating current from standard AC line voltage (e.g., 120 VAC). Decorative light strings 16, 18, 20 and 22 are series connected. First decorative LED light string 16 is connected to power supply 14 via connector pair 26. Second decorative LED light string 18 is connected to first decorative LED light string 16 via connector pair 28. Third decorative LED light string 20 is connected to second decorative LED light string 18 via connector pair 30. Fourth decorative LED light string 22 is connected to third decorative LED light string 20 via connector pair 32. Each of connector pairs 26, 28, 30 and 32 include a connector coupled to a first of the connected elements (e.g., a connector of power supply 14), and a complementary connector coupled to a second of the connected elements (e.g., a connector of first decorative light string 16).

Operating power for decorative LED light strings 16, 18, 20 and 22 is provided by power supply 14. In some embodiments, power supply 14 converts power from standard AC line voltage to a form compatible with LED light strings 16, 18, 20 and 22. For example, in an exemplary embodiment power supply 14 converts 120 VAC power to high-voltage DC power. In other embodiments, however, decorative light strings 16, 18, 20 and 22 can be made to be compatible with 120 VAC. In such embodiments, power supply 14 can be omitted, and first decorative LED light string 16 can be directly plugged into house outlet 24. Regardless of the specific power configuration, the chain of series-connected decorative LED light strings 16, 18, 20 and 22 is supplied operating power, both voltage and current, through the connector of connector pair 26 that is coupled to first decorative LED light string 16.

All operating current for decorative LED light strings 16, 18, 20 and 22 will be conducted through connector pair 26 in lighting system 12 as depicted in FIG. 1. Connector pair 28 will conduct operating current for decorative LED light strings 18, 20 and 22. Connector pair 30 will conduct operating current for decorative LED light strings 20 and 22. Connector pair 32 will conduct operating current only for decorative LED light strings 22. Operating power for decorative LED light strings 16, 18, 20 and 22 is calculated as the product of the operating voltage and the operating current. Thus, a specific operating power can be achieved using different voltages and currents. For example, a first power configuration may use high operating current and low operating voltage to achieve a specific operating power, while a second power configuration may use a lower operating current a higher operating voltage.

Although both the first and second power configurations achieve the same operating power, the current differences can have secondary consequence. Because the operating current for light strings 16, 18, 20 and 22 is conducted through connector pair 26, a voltage drop will occur across connector pair 26, as connector pair 26 has a non-zero parasitic resistance associated with connector pair 26. Furthermore, a voltage drop will occur across both decorative LED light sting 16 and connector pair 28 due to parasitic resistances, as a result of conduction therethrough of operating current for lights strings 18, 20 and 22. The first power configuration, which achieves the specific operating power using high operating currents will have larger voltage drops across lighting elements 26, 16, 28, etc. than will the second power configuration which achieves the same specific operating power but uses lower operating currents. Use of high-voltage/low-current power configurations can permit the use of long chains of series-connected decorative LED light strings.

Figure 2:
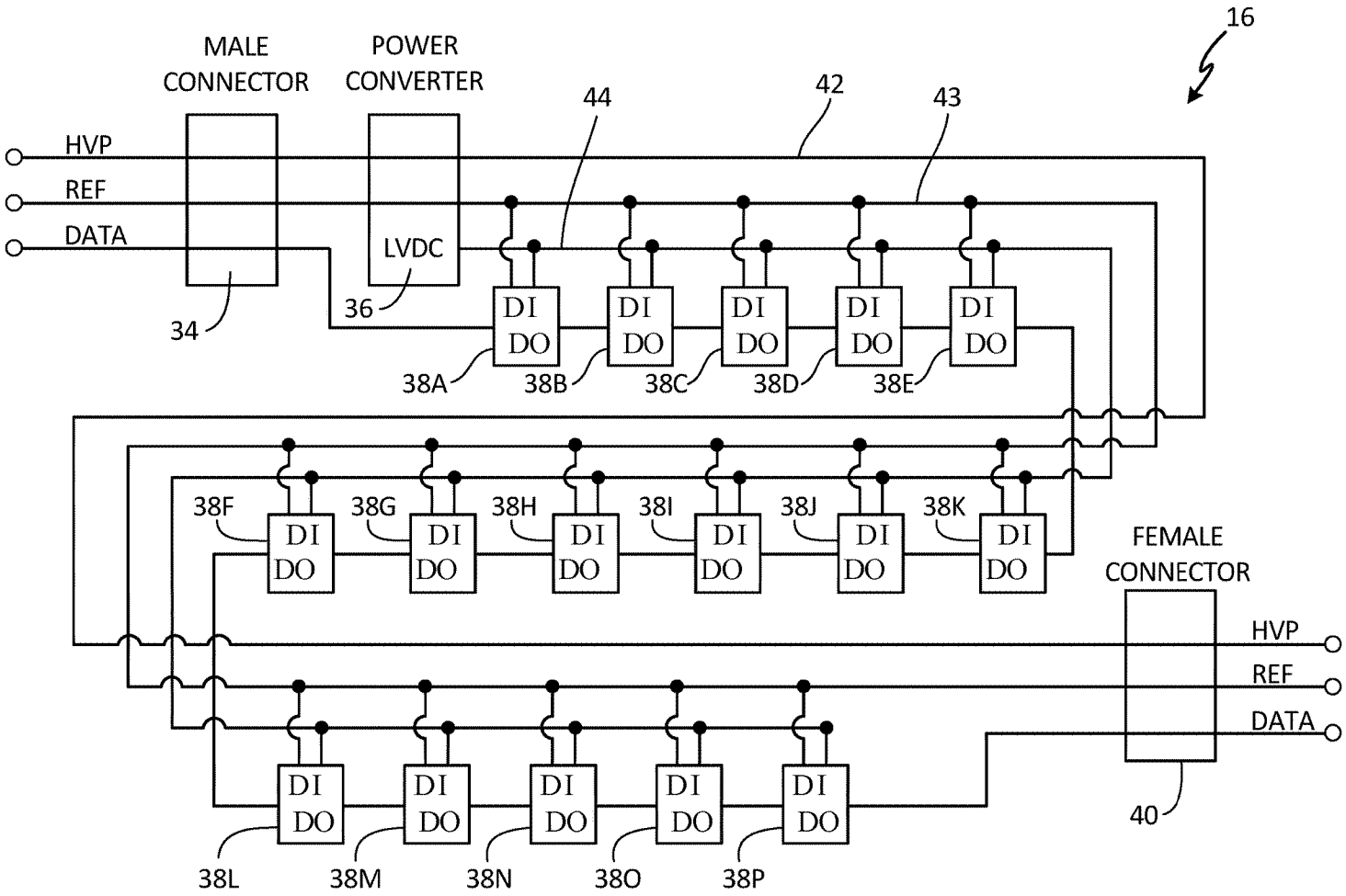
FIG. 2 is a schematic diagram of an exemplary long-chain-tolerant decorative LED light string.

FIG. 2 is a schematic diagram of an exemplary long-chain-tolerant decorative LED light string. In FIG. 2, decorative LED light string 16 of FIG. 1 is shown in schematic form. Decorative LED light string 16 includes first connector 34, power converter 36, lighting elements 38A-38P, and second connector 40. First connector 34 is labeled as MALE CONNECTOR, and second connector 40 is labeled as FEMALE CONNECTOR in the depicted embodiment. Various embodiments can have various configurations of connectors. To facilitate series connectivity of multiple decorative LED light stings, however, first connector 34 and second connector 40 are complementary connectors. Connectors are complementary when they mate or engage with one another. Thus, first connector 34 of a subsequent and decorative LED light string (and perhaps identical to decorative LED light string 16, e.g., decorative light string 18 depicted in FIG. 1) can mate or engage with second connector 40 of decorative LED light string 16 depicted in FIGS. 1 and 2, if first connector 34 and second connector 40 are complementary to one another.

In the depicted embodiment connectors 34 and 40 each has three contacts. First connector 34 has contacts labeled: i) high-voltage power HVP; ii) power reference REF; and iii) and data-in DATA. Second connector 40 has contacts labeled: i) high-voltage power HVP; ii) power reference REF; and iii) data-out DATA. Contacts HVP and REF of first connector 34 receive operating power for decorative LED light string 16. Conductors 42 and 43 provide electrical conduction of the received operating power to both power converter 36 and second connector 40. Second connector 40 thereby provides operating power to one or more additional decorative LED light string attached thereto.

Power converter 36 converts the received high-voltage power to a low-voltage DC power suitable for consumption by lighting elements 38A-38P. In some embodiments, the received high-voltage power is 120 VAC line power. In such embodiments, power converter 36 converts the received 120 VAC line power to the low-voltage DC power suitable for consumption by lighting elements 38A-38P. In some embodiments, the received high-voltage power is a high-voltage DC power. For example, in an exemplary embodiment, power supply (depicted in FIG. 1) converts 120 VAC line power to high-voltage DC power by rectifying and filtering the 120 VAC line power. In such embodiments, power converter 36 converts the received high-voltage DC power to the low-voltage DC power suitable for consumption by lighting elements 38A-38P. In still other embodiments, power converter 36 is configured to convert power from other high-voltage power specifications to the low-voltage DC power suitable for consumption by lighting elements 38A-38P.

In the depicted embodiment, power converter 36 provides the low-voltage DC power suitable for consumption by lighting elements 38A-38P on conductor 44. In the depicted embodiment, the converted low-voltage DC power provided to conductor 44 is referenced to power reference REF of conductor 42. Conductors 43 and 44 provide the converted low-voltage DC power to each of lighting elements 38A-38P. In some embodiments, the converted low-voltage DC power will have an isolated reference, independent of power reference REF of conductor 43. In such embodiments, an additional conductor will provide the isolated reference voltage to lighting elements 38A-38P. In such embodiments, the additional conductor along with conductor 44 can provide the converted low-voltage DC power to each of lighting elements 38A-38P.

Lighting elements 38A-38P are identical to one another in the depicted embodiment. Lighting elements 38A-38P are wired in daisy chain fashion from the data-in contact of first connector 34 to the data-out contact of second connector 40 via data-in DI and data-out DO ports of lighting elements 38A-38P. First connector 34 receives illumination control data on the data-in contact of first connector 34. The received illumination control data can independently control the illumination of each of lighting elements 38A-38P, as well as independently controlling lighting elements of one or more decorative LED light strings attached to second connector 40. The received illumination control data may include brightness control, color control, and/or temporal control (e.g., flashing or other temporal lighting variations).

Each of daisy-chained lighting elements 38A-38P receives the illumination control data at data-in port DI. Each of daisy-chained lighting elements 38A-38P then process the received illumination control data and control the illumination based on the received illumination control data. The received illumination control data includes data corresponding to the lighting element that receives the data as well as data corresponding to lighting elements downstream the daisy chain of lighting elements from the lighting element that receives the data. Thus, each of the daisy-chained lighting elements 38A-38P transmits at least some of the received illumination data to downstream lighting elements via the data-out port DO of the lighting element.

Figure 3:
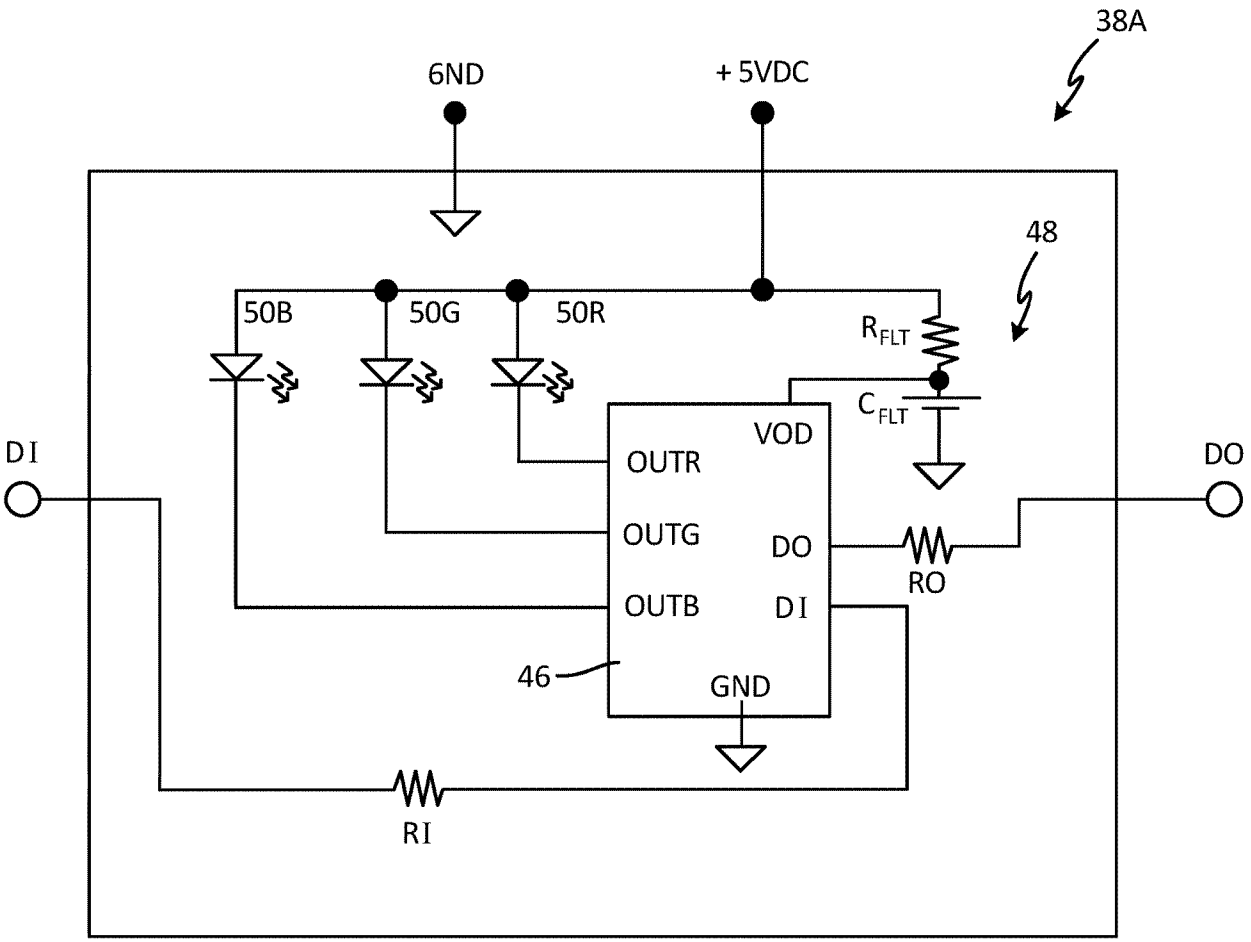
FIG. 3 is a circuit schematic diagram of an exemplary lighting element of a long-chain-tolerant decorative LED light string.

FIG. 3 is a circuit schematic diagram of an exemplary lighting element of a long-chain-tolerant decorative LED light string. In FIG. 3, lighting element 38A of FIG. s is shown in schematic form. Lighting element 38A includes data-in port DI, data-out port DO, ground port GND, low-voltage DC, and power port +5 VDC. Lighting element 38A also includes illumination controller 46, resistors RI and RO, power filter 48, and LEDs 50R, 50G and 50B. In the depicted embodiment, power filter 40 includes resistor $R_{FLT}$ and capacitor $C_{FLT}$. In various embodiments, various power filters can be used. For example, in some embodiments, an inductor can be used in addition to or replacing resistor $R_{FLT}$. In an exemplary embodiment, no power filter is used.

Illumination controller 46 has pins: i) power VDD; ii) ground GND; iii) data-in DI; iv) data-out DO; v) red LED control OUTR; vi) green LED control OUTG; and vii) blue LED control OUTB. LEDs 50R, 50G and 50B each have cathodes that are electrically connected both to one another and to the low-voltage DC power (e.g., +5 VD in the depicted embodiment). Illumination controller 46 controls currents flowing through each of LEDs 50R, 50G and 50B via control pins OUTR, OUTG and OUTB, respectively. Illumination controller 46 controls the currents flowing through LEDs 50R, 50G and 50B based on the illumination control data received on the data-in port DI of lighting element 38A and electrically conducted to the data-in pin DI of illumination controller 46.

In various embodiments, lighting elements 38A-38P can include various configurations of LEDs. For example, in an exemplary embodiment lighting elements 38A-38P can include a red LED, a green LED, and a blue LED. In some embodiments, lighting elements 38A-38P can include other types of LEDs, such as, for example, warm white, pure white, ultra-violet (UV), deep blue, and/or amber LEDs. Such types of LEDs can be including alone or in various combinations in lighting elements 38A-38P.

In various embodiments, illumination controller 46 controls the illumination color, brightness, temporal pattern of illumination. For example, illumination controller 46 can control color by controlling the relative intensities of the red, green and blue light illuminated by LEDs 50R, 50G and 50B, respectively. Illumination controller 46 can control brightness by controlling the absolute intensity of the combination of red, green and blue light illuminated by LEDs 50R, 50G and 50B, respectively. Illumination controller 46 can control the temporal pattern of illumination by temporally changing these relative and absolute intensities as a function of time.

Figure 4:
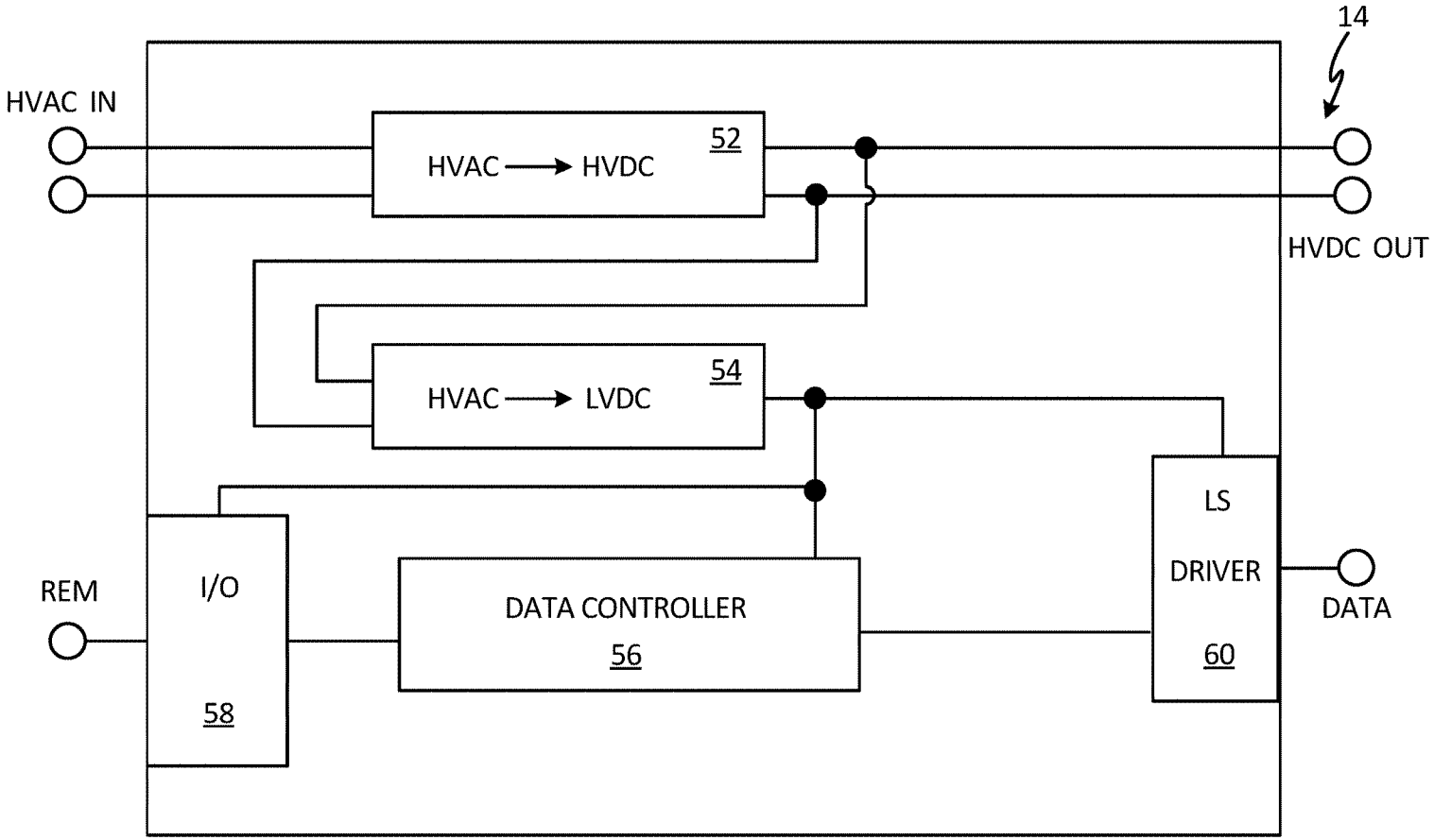
FIG. 4 is a circuit schematic of an exemplary power supply for a long chain of decorative LED light strings.

FIG. 4 is a block schematic of an exemplary power supply for a long chain of decorative LED light strings. In FIG. 4, exemplary power supply 14 depicted in FIG. 1 is shown in block diagram form. Power supply 14 high-voltage AC/high-voltage DC converter, 52, high-voltage DC/low-voltage DC converter 54, data controller 56, input/output interface 58 and light-string driver 60. Power supply 14 also has high-voltage AC input port HVAC_IN, high-voltage DC output port HVDC_OUT, remote data input port REM, and light-string data output port DATA.

High-voltage AC/high-voltage DC converter 52 received high-voltage AC power from high-voltage AC input port HVAC_IN. High-voltage AC/high-voltage DC converter 52 converts the received high-voltage AC power to high-voltage DC power and provide the converted high-voltage DC power to a connected chain of light strings via high-voltage DC output port HVDC_OUT, and provides the converted high-voltage DC power to high-voltage DC/low-voltage DC converter 54. High-voltage DC/low-voltage DC converter 54 converts the received high-voltage DC power to low-voltage DC power and provides the converted low-voltage DC power to each of data controller 56, input/output interface 58 and light-string driver 60.

Data controller 56 generates an illumination control signal and provides it to the connected chain of light strings via light-string data output port DATA. Data controller may store data corresponding to various illumination patterns, and/or may receive various illumination patterns from a remote pattern generator via input/output interface 58.

Figure 5:
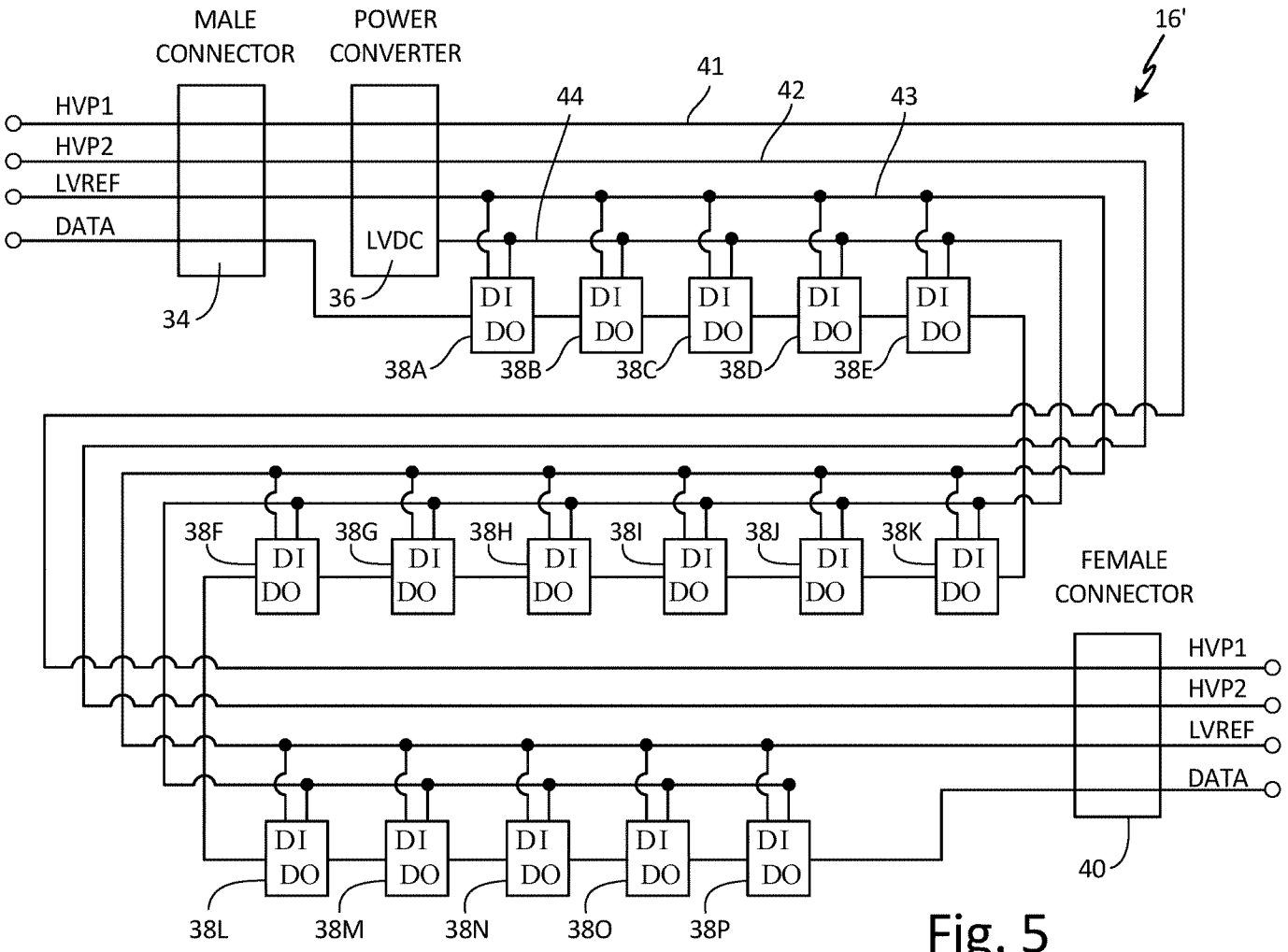
FIG. 5 is a schematic diagram of an exemplary long-chain-tolerant decorative LED light string with separate high-voltage and low-voltage references.

FIG. 5 is a schematic diagram of an exemplary long-chain-tolerant decorative LED light string with separate high-voltage and low-voltage references. Decorative LED light sting 16' depicted in FIG. 5 is the same as Decorative LED light string 16 shown in FIG. 2, except that it has one additional electrical conductor. In the depicted embodiment connectors 34 and 40 each has four contacts. First connector 34 has contacts labeled: i) first high-voltage power HVP1; ii) second high-voltage power HVP2; iii) low-voltage reference LVREF; and iv) and data-in DATA. Second connector 40 has contacts labeled: i) first high-voltage power HVP1; ii) second high-voltage power HVP2; iii) low-voltage reference LVREF; and iv) data-out DATA. Contacts HVP1 and HVP 2 of first connector 34 receive operating power for decorative LED light string 16. Conductors 41 and 42 provide electrical conduction of the received high-voltage operating power to both power converter 36 and second connector 40. Second connector 40 thereby provides operating power to one or more additional decorative LED light string attached thereto.

Power converter 36 converts the received high-voltage power to a low-voltage DC power suitable for consumption by lighting elements 38A-38P. In some embodiments, the received high-voltage power is 120 VAC line power. In such embodiments, power converter 36 converts the received 120 VAC line power to the low-voltage DC power suitable for consumption by lighting elements 38A-38P. In some embodiments, the received high-voltage power is a high-voltage DC power. For example, in an exemplary embodiment, power supply (depicted in FIG. 1) converts 120 VAC line power to high-voltage DC power by rectifying and filtering the 120 VAC line power. In such embodiments, power converter 36 converts the received high-voltage DC power to the low-voltage DC power suitable for consumption by lighting elements 38A-38P. In still other embodiments, power converter 36 is configured to convert power from other high-voltage power specifications to the low-voltage DC power suitable for consumption by lighting elements 38A-38P.

In the depicted embodiment, power converter 36 provides the low-voltage DC power suitable for consumption by lighting elements 38A-38P on conductors 43 and 44. In the depicted embodiment, the converted low-voltage DC power provided to conductors 43 and 44 is referenced to power reference REF of conductor 43. Conductors 43 and 44 provide the converted low-voltage DC power to each of lighting elements 38A-38P. In the depicted embodiment, the converted low-voltage DC power has an isolated reference from the high-voltage power received on conductors 41 and 42.

Figure 6:
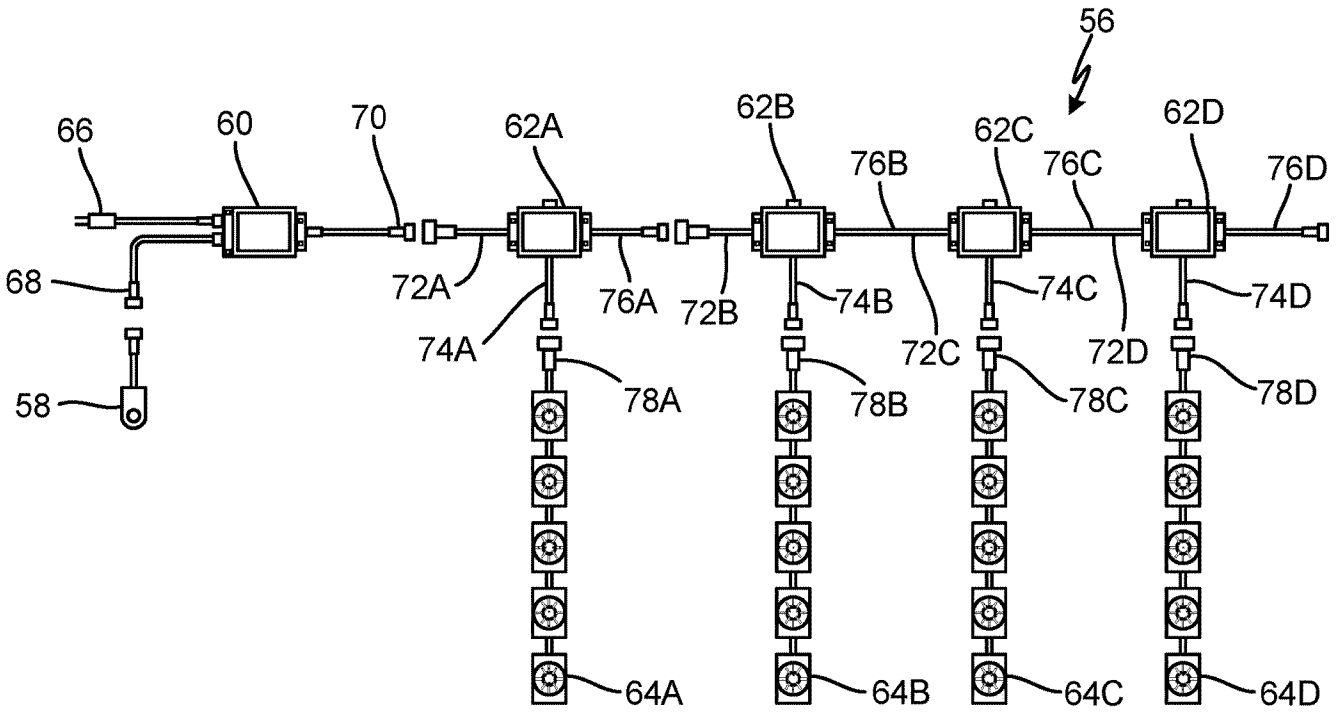
FIG. 6 is a schematic diagram of an embodiment of a curtain configured decorative lighting system.

FIG. 6 is a schematic diagram of an embodiment of a curtain configured decorative lighting system. In FIG. 6, decorative lighting system 56 includes system controller 58, power adaptor 60, light-string distribution members 62A, 62B, 62C and 62D, decorative light strings 64A, 64B, 64C and 64D. Decorative lighting system 56 is curtain configured, because decorative light strings 64A, 64B, 64C and 64D are connect in a curtain fashion to a figurative curtain rod fashioned from light-string distribution members 62A, 62B, 62C and 62D. Lighting system controller 58 generates a signal indicative of a plurality of lighting commands. For example, lighting system controller 58 can generate a signal to cause 100 lighting elements to be illuminated in a fashion in which alternating lights are of different colors. Lighting system controller 58 can cause some of the 100 lighting elements to flash on and off in a predetermined temporal fashion. Light string controller 58 can cause the 100 lights to change their colors in a temporal fashion. Lighting system controller 58 can be programmed to store and retrieve various programs of lighting shows to be used for various lighting configurations.

Power adapter 60 includes power connector 66, lighting controller connector 68 and light connector 70. In some embodiments, power adapter 60 receives AC power via power connector 66 and converts the received AC power to high-voltage DC power. The converted high-voltage DC power is provided, via light connector 70, to light-string distribution members 62A, 62B, 62C and 62D, decorative light strings 64A, 64B, 64C and 64D as operating power. In some embodiments, power adapter 60 receives, via lighting controller connector 68, the signal indicative of a plurality of lighting commands generated by lighting system controller 58. Power adapter 60 then provides the received signal indicative of a plurality of lighting commands to light-string distribution members 62A, 62B, 62C and 62D, decorative light strings 64A, 64B, 64C and 64D via lighting connector 70.

Each of light-string distribution members 62A, 62B, 62C and 62D, has conductive lead 72A, 72B, 72C and 72D, tap connector 74A, 74B, 74C and 74D and conductive tail 76A, 76B 76C and 76D, respectively. In some embodiments, conductive leads 72A, 72B, 72C and 72D and/or conductive tails 76A, 76B 76C and 76D have a connector attached thereto. In some embodiments, conductive leads 72A, 72B, 72C and 72D and/or conductive tails 76A, 76B 76C and 76D have no connector attached thereto. In such embodiments, the light-string distribution members are fixedly attached to one another.

Conductive leads 72A, 72B, 72C and 72D are each configured to connect to an upstream element of decorative lighting system 56. The upstream element is the lighting element on the power adapter side of and to which is attached light-string distribution members 72A, 72B, 72C and 72D. For example, power adapter 60 is the upstream element to which light-string distribution member 72A is connected. Light-string distribution member 72A is the upstream element to which light-string distribution member 72B is attached. Light-string distribution member 72B is the upstream element to which light-string distribution member 72C is attached. Finally, Light-string distribution member 72C is the upstream element to which light-string distribution member 62D is attached.

Conductive tails 76A, 76B, 76C and 76D are each configured to connect to a downstream element of decorative lighting system 56. The downstream element is the lighting element away from the power adapter side of light-string distribution members 72A, 72B, 72C and 72D. For example, light-string distribution member 72B is the downstream element to which light-string distribution member 72A is attached. Light-string distribution member 72C is the downstream element to which light-string distribution member 72B is attached. Light-string distribution member 72D is the downstream element to which light-string distribution member 72C is attached. Finally, Light-string distribution member 72D is not attached to a downstream element.

Each of decorative light strings 64A, 64B, 64C and 64D has a plurality of lighting elements as indicated in the drawing. Decorative light strings 64A, 64B, 64C and 64D have connectors 78A, 78B, 78C and 78D configured to connect to tap connectors 74A, 74B, 74C and 74D of light-string distribution members 62A, 62B, 62C and 62D, respectively. Each of connectors 78A, 78B, 78C and 78D is configured to connect to receive, from light-string distribution members 62A, 62B, 62C and 62D, operating power.

Each of connectors 78A, 78B, 78C and 78D is also configured to connect to receive, from light-string distribution members 62A, 62B, 62C and 62D, an input signal indicative of a plurality of lighting commands. The plurality of lighting commands includes lighting commands for each of the plurality of lighting elements of that decorative light string 62A, 62B, 62C and 62D to which it pertains as well as lighting commands for the plurality of lighting elements of decorative lights strings 62B, 62C and 62D downstream. For example, decorative light string 64C receives, via connector 78C, lighting command for itself as well as lighting commands for decorative light string 64D. Decorative light string 64B receives, via connector 78B, lighting command for itself as well as lighting commands for decorative light strings 64C and 64D. Decorative light string 64A receives, via connector 78A, lighting command for itself as well as lighting commands for decorative light strings 64B, 64C and 64D.

The plurality of lighting elements of each of decorative light strings 64A, 64B, 64C and 64D receives, via a data-in port, the input signal received by connectors 78A, 78B, 78C and 78D. In some embodiments the input signal includes a time sequence of sub-signals, each of which indicative one of the plurality of lighting commands indicated by the input signal. Each of the plurality of lighting elements responds in accordance with the lighting command indicated by the first of the received sub-signals passed thereto, and transmits, via a data-out port, the sub-signals following the first of the received lighting commands. Thus, a train of lighting commands is sequentially provide to the plurality of lighting elements, each element stripping the first sub-lighting command from the train and passing the remaining lighting commands to the lighting element coupled thereto. After the last of the series of lighting elements has received the train of lighting commands, the train of remaining lighting commands is provided, as indicated by an output signal, to connectors 78A, 78B, 78C and 78D so that light-string distribution members 62A, 62B, 62C and 62D can receive these lighting commands and provide them to the downstream element to which light-string distribution members 62A, 62B, 62C and 62D are connected.

Figure 7:
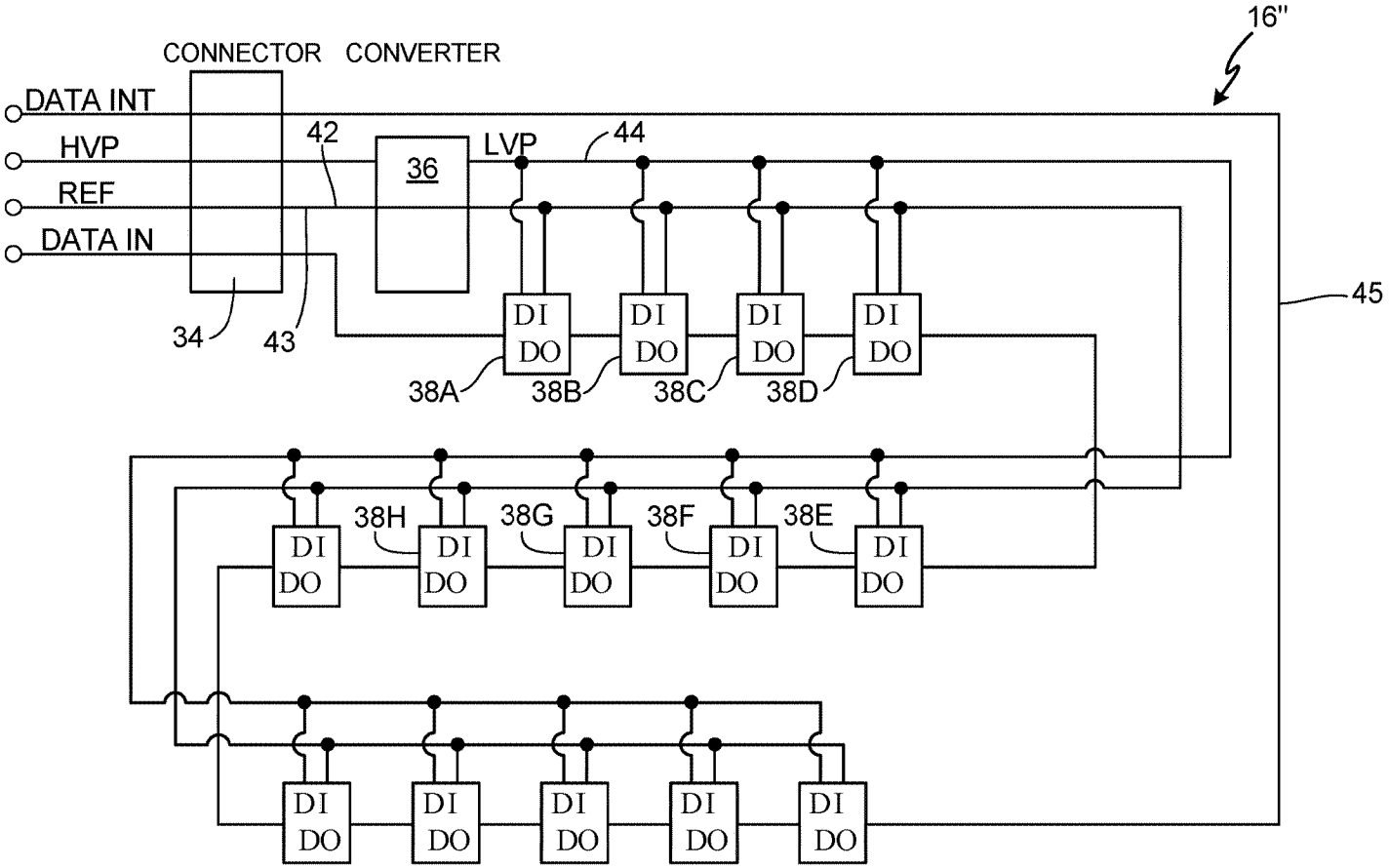
FIG. 7 is a block diagram of an embodiment of a decorative light string configured as a curtain member.

FIG. 7 is a block diagram of an embodiment of a decorative light string configured as a curtain member. In FIG. 7, decorative LED light string 16" includes connector 34, power converter 36, and lighting elements 38A-38P. Some embodiments do not have power converter 36, as such power conversion can be performed in the light-string distribution module to which decorative light string 16" is attached. Connector 34 has four contacts in the depicted embodiment. Connector 34 has contacts labeled: i) high-voltage power (HVP); ii) power reference (REF); iii) data-in; and iv) data-out. Contacts HVP and REF of connector 34 receive operating power for decorative LED light string 16". Conductors 42 and 43 provide electrical conduction of the received operating power to power converter 36.

Power converter 36 converts the received high-voltage power to a low-voltage DC power (LVP) suitable for consumption by lighting elements 38A-38P. In some embodiments, the received high-voltage power is 120 VAC line power. In such embodiments, power converter 36 converts the received 120 VAC line power to the low-voltage DC power suitable for consumption by lighting elements 38A-38P. In some embodiments, the received high-voltage power is a high-voltage DC power. For example, in an exemplary embodiment, power supply (depicted in FIG. 1) converts 120 VAC line power to high-voltage DC power by rectifying and filtering the 120 VAC line power. In such embodiments, power converter 36 converts the received high-voltage DC power to the low-voltage DC power suitable for consumption by lighting elements 38A-38P. In still other embodiments, power converter 36 is configured to convert power from other high-voltage power specifications to the low-voltage DC power suitable for consumption by lighting elements 38A-38P.

In the depicted embodiment, power converter 36 provides the low-voltage DC power suitable for consumption by lighting elements 38A-38P on conductor 44. In the depicted embodiment, the converted low-voltage DC power provided to conductor 44 is referenced to power reference REF of conductor 42. Conductors 43 and 44 provide the converted low-voltage DC power to each of lighting elements 38A-38P. In some embodiments, the converted low-voltage DC power will have an isolated reference, independent of power reference REF of conductor 43. In such embodiments, an additional conductor will provide the isolated reference voltage to lighting elements 38A-38P. In such embodiments, the additional conductor along with conductor 44 can provide the converted low-voltage DC power to each of lighting elements 38A-38P.

Lighting elements 38A-38P are identical to one another in the depicted embodiment. Lighting elements 38A-38P are wired in daisy chain fashion from the data-in contact of first connector 34 to the data-out contact of second connector 40 via data-in DI and data-out DO ports of lighting elements 38A-38P. First connector 34 receives illumination control data on the data-in contact of first connector 34. The received illumination control data can independently control the illumination of each of lighting elements 38A-38P, as well as independently controlling lighting elements of one or more decorative LED light strings attached to second connector 40. The received illumination control data may include brightness control, color control, and/or temporal control (e.g., flashing or other temporal lighting variations).

Each of daisy-chained lighting elements 38A-38P receives the illumination control data at data-in port DI. Each of daisy-chained lighting elements 38A-38P then process the received illumination control data and control the illumination based on the received illumination control data. The received illumination control data includes data corresponding to the lighting element that receives the data as well as data corresponding to lighting elements downstream the daisy chain of lighting elements from the lighting element that receives the data. Thus, each of the daisy-chained lighting elements 38A-38P transmits at least some of the received illumination data to downstream lighting elements via the data-out port DO of the lighting element. The last 38P of the lighting elements 38A-38P outputs the signal indicative of a plurality of lighting commands to conductor 45, which provides the signal indicative of a plurality of lighting commands to connector 34. Connector 34, in turn, provides the signal indicative of a plurality of lighting commands back to a light-string distribution element, to which it is attached.

Figure 8:
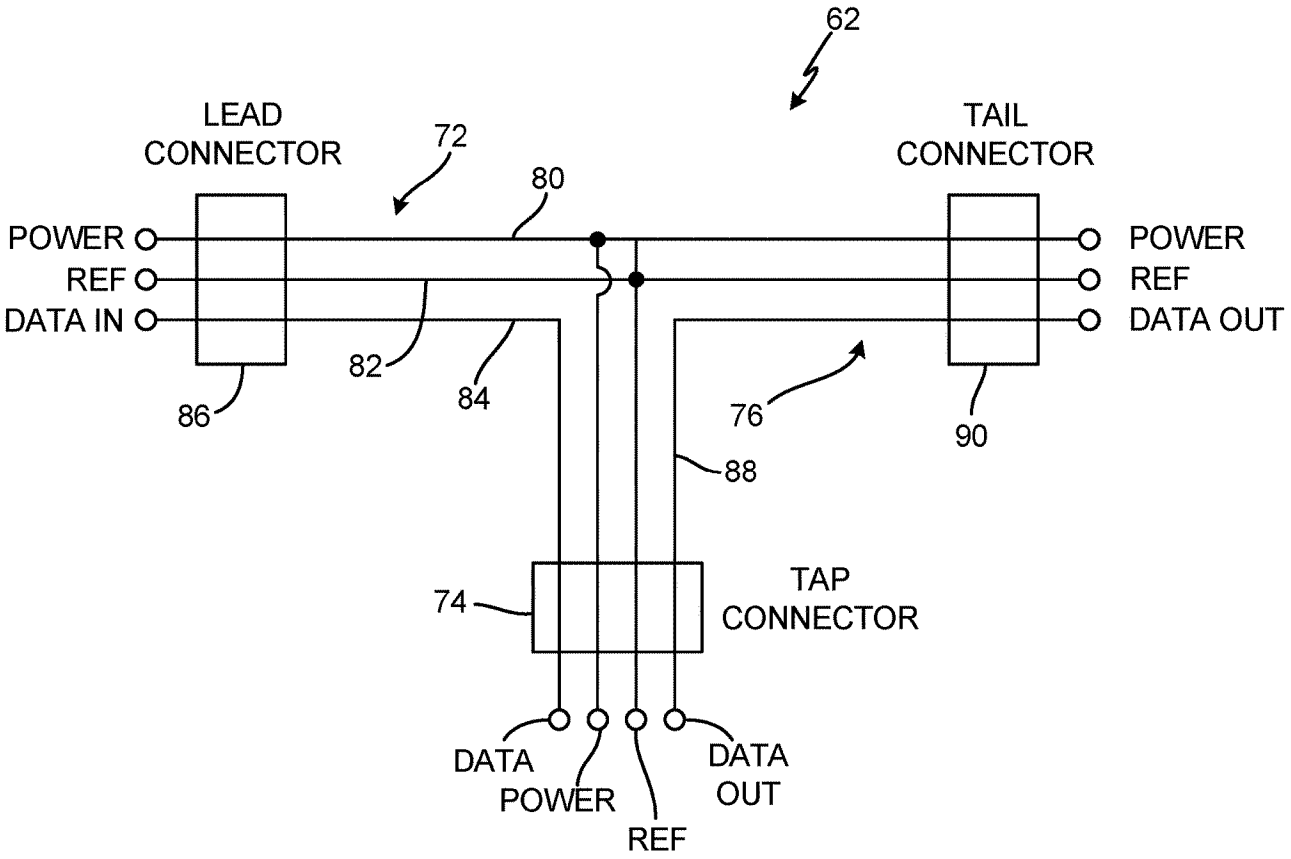
FIG. 8 is a block diagram of an embodiment of a light-string distribution member for use in a curtain configured decorative lighting system.

FIG. 8 is a block diagram of an embodiment of a light-string distribution member for use in a curtain configured decorative lighting system. In FIG. 8, light-string distribution member 62 includes conductive lead 72, tap connector 74 and conductive tail 76. In the depicted embodiment, conductive lead 72 includes three separate conductive wires—power conductor 80, reference conductor 82, and data-in conductor 84. Light-string distribution member 62 has lead connector 86 configured to releasably couple conductors 80, 82 and 84 to an upstream element of a decorative lighting system. In the depicted embodiment, conductive tail 76 includes three separate conductive wires—power conductor 80, reference conductor 82, and data-out conductor 88. Light-string distribution member 62 has tail connector 90 configured to releasably couple conductors 80, 82 and 88 to a downstream element of a decorative lighting system. Tap connector is configured to releasably couple conductors 80, 82, 84 and 88 to a decorative light string attached thereto.

Figure 9:
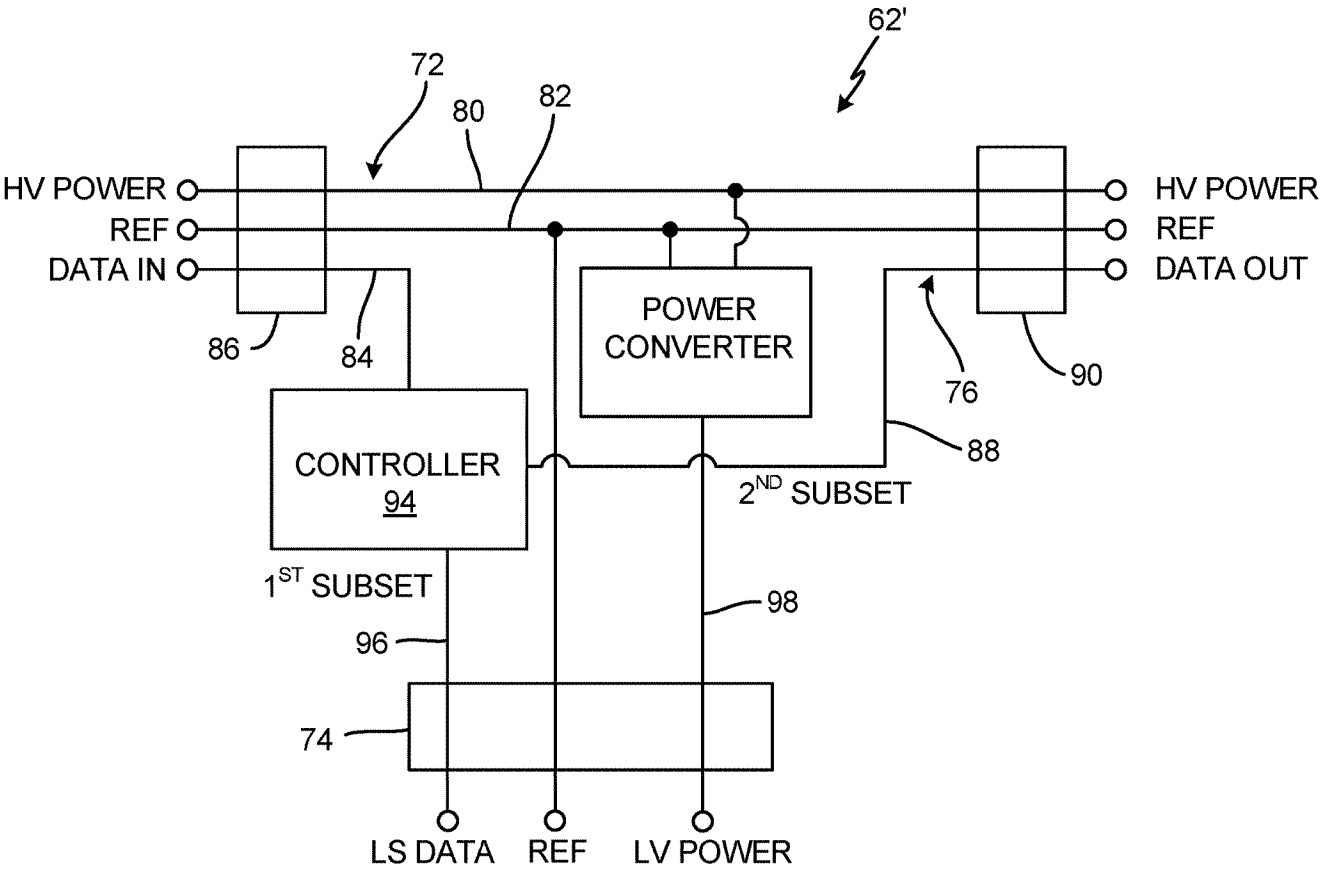
FIG. 9 is a block diagram of another embodiment of a light-string distribution member for use in a curtain configured decorative lighting system.

FIG. 9 is a block diagram of another embodiment of a light-string distribution member for use in a curtain configured decorative lighting system. In FIG. 9, light-string distribution member 62' includes conductive lead 72, tap connector 74, conductive tail 76, power converter 92, and controller 94. In the embodiment depicted, instead of providing the data-in signal, received by conductive lead 72, directly to tap connector 74, the received data-in signal is provided to controller 94. Controller 94 sends, to tap connector 74 via conductor 96, only the sub-signals of the received data-in signal that pertain to the decorative lighting element connected thereto. Controller 94 then sends, to conductive tail 76 via conductor 88, only the sub-signals of the received data-in signal that pertain to decorative lighting elements connected via conductive tail 76. The FIG. 9 embodiment also depicts power converter 92, which converts the power conducted by conductor 80 from high voltage to low voltage. Conductor 98 provides the low-voltage power to tap connector 74 via conductor 98.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. A light-string distribution element for a decorative lighting system, the light-string distribution element comprising:

a conductive lead configured to connect to an upstream element of the decorative lighting system and further configured to:

receive, from the upstream element connected thereto, operating power; and receive, from the upstream element connected thereto, an input signal indicative of a plurality of lighting commands, each configured to cause a particular lighting element to illuminate in a specific manner indicated by that lighting command;

a tap connector configured to connect to a complementary connector of a decorative light string having a plurality of lighting elements, the tap connector further configured to:

provide, to the decorative light string connected thereto, operating power received by the conductive lead; and provide, to the decorative light string connected thereto, a first output signal indicative of a first subset of the plurality of lighting commands, the first subset corresponding to lighting commands for a plurality of lighting elements of the decorative light sting connected thereto; and a conductive tail configured to connect to a downstream element and further configured to:

provide, to the downstream element connected thereto, operating power received by the conductive lead; and provide, to the downstream element, a second output signal indicative of a second subset of the plurality of lighting commands, the second subset including lighting commands for a plurality of lighting elements of other decorative light stings connected via the downstream element.

2. The light-string distribution element of claim 1, wherein the second subset of the plurality of lighting commands includes all lighting commands indicated by the input signal received by the conductive lead except for the first subset of the plurality of lighting commands.

3. The light-string distribution element of claim 1, wherein the second subset of the plurality of lighting commands excludes lighting commands of the first subset of the plurality of lighting commands.

4. The light-string distribution element of claim 1, wherein the first output signal, provided by the tap connector to the decorative light string connected thereto, is the input signal received by the conductive lead, the tap connector further configured to:

receive, from the decorative light string connected thereto, the second output signal indicative of the second subset of the plurality of lighting commands.

5. The light-string distribution element of claim 1, wherein the input signal is comprised of a time sequence of sub-signals, each sub-signal corresponding to and indicative of one of the plurality of lighting commands.

6. The light-string distribution element of claim 5, further comprising:

a controller coupled to the conductive lead, to the conductive tail, and to the tap connector, the controller configured to:

receive, from the conductive lead, operating power;

receive, from the conductive lead, the input signal indicative of a plurality of lighting commands;

generate the first output signal by directing, to the tap connector, a first predetermined number of sub-signals indicative of the lighting commands for the plurality of lighting elements of the decorative light string connected thereto; and generate the second output signal by directing, to the conductive tail, the sub-signals following the first predetermined number.

7. The light-string distribution element of claim 5, wherein the operating power received by the conductive lead and provided to the conductive tail is a high-voltage power having a voltage greater than or equal to 50 Volts, the light-string distribution element further comprising:

a power converter configured to:

receive, from the conductive lead, the high-voltage power;

convert the received high-voltage power to a low-voltage power having a voltage less than or equal to 15 Volts;

provide, as the operating power to the tap connector, the low-voltage power.

8. The light-string distribution element of claim 1, wherein first and second subsets of lighting commands are complementary one to another, such that the first subset includes lighting commands only for the plurality of lighting elements of the decorative light stings connected to the tap connector, and the second subset includes lighting commands not for a plurality of lighting elements of the decorative light sting connected to the tap connector.

9. The light-string distribution element of claim 1, further comprises:

a lead connector on the conductive lead of the light-string distribution element and configured to couple to a complementary connector of the upstream element; and a tail connector coupled on the conductive tail of the light-string distribution element configured to couple to a complementary connector of the downstream element.

10. A light-string distribution bus comprising a plurality of the light string distribution elements of claim 1, wherein the plurality of light string distribution elements are serially connected, conductive lead to conductive tail, such that the each of the tap connectors of the plurality of light-string distribution elements is configured to connect to one of a plurality of decorative light strings.

11. The light-string distribution bus of claim 10, further comprising:

a lead connector on the conductive lead of the first of the plurality of light-string distribution elements, the lead connector configured to couple to a complementary connector of the upstream element; and a tail connector coupled on the conductive tail of a last of the plurality of light-string distribution elements, the tail connector configured to couple to a complementary connector of the downstream element.

12. A decorative light string comprising:

a plurality of lighting elements distributed along the decorative light string, each of the plurality of lighting elements configured to illuminate in a manner indicated by a light-control signal corresponding to that lighting element; and a connector configured to:

receive, from a light-string distribution member connected thereto, operating power;

receive, from the light-string distribution member connected thereto, an input signal indicative of a plurality of lighting commands, the plurality of lighting commands including first and second subsets of the plurality of lighting commands, each lighting command of the first subset configured to cause one of the plurality of lighting elements to illuminate in a specific manner indicated by that lighting command; and provide, to the tap connector, an output signal indicative of the lighting commands of the second subset, wherein the second subset of the plurality of lighting commands includes all lighting commands indicated by the input signal received by the connector except for the first subset of the plurality of lighting commands.

13. The decorative light string of claim 12, wherein each of the plurality of lighting elements includes a red LED, a green LED, and a blue LED.

14. The decorative light string of claim 13, wherein each of the plurality of lighting elements further includes an additional LED selected from the group consisting of: a warm white LED; a pure white LED; an amber LED; an Ultra-Violet (UV) LED; and a deep blue LED.

15. The decorative light string of claim 12, wherein each of the plurality of lighting elements distributed has a data-in port and a data-out port, the plurality of lighting elements wired in a daisy-chain fashion, via the data-in and data-out ports from the connector to a last of the plurality of lighting elements.

16. The decorative light string of claim 15, wherein each of the plurality of lighting elements further comprises:

a controller configured to receive a data-in signal at its data-in port and to provide a data-out signal to its data-out port.

17. The decorative light string of claim 16, wherein the controller of each of the plurality of lighting elements is configured to control, in response to the received data-in signal, brightness of each of a red, green, and blue LEDs of that lighting element.

18. The decorative light string of claim 12, wherein the operating power received by the connector is a high-voltage power having a voltage greater than or equal to 50 Volts, the decorative light string further comprising:

a power converter configured to:

receive, from the connector, the high-voltage power;

convert the received high-voltage power to a low-voltage power having a voltage less than or equal to 15 Volts;

provide, to the plurality of lighting elements, the low-voltage power.

19. The decorative light string of claim 18, wherein the plurality of lighting elements distributed along the decorative light string are arranged in an ordered sequence, wherein a first lighting element of the ordered sequence of lighting elements is configured to receive the input signal received by the connector, wherein a last lighting element of the ordered sequence of lighting elements is configured to provide a data signal to the second connector, wherein each lighting element of the ordered sequence between the first and the last lighting elements of the ordered sequence of lighting elements is configured to receive a data signal from a preceding adjacent lighting element and is further configured to supply a data signal to a succeeding adjacent lighting element.

20. The decorative light string of claim 19, wherein the data signal provided by each lighting element to a succeeding lighting element is indicative of lighting commands for all of the elements of the decorative light string except for that lighting element and those lighting elements preceding that lighting element in ordered sequence.

* * * * *